US012584401B2

(12) United States Patent
Machocki et al.

(10) Patent No.: US 12,584,401 B2
(45) Date of Patent: Mar. 24, 2026

(54) MONITORING A DRILL STRING CONTROLLED BY A DRILLING PROGRAM

(71) Applicant: SAUDI ARABIAN OIL COMPANY, Dhahran (SA)

(72) Inventors: Krzysztof Karol Machocki, Aberdeen (GB); Arturo Magana-Mora, Dhahran (SA); Chinthaka Gooneratne, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 99 days.

(21) Appl. No.: 17/080,167

(22) Filed: Oct. 26, 2020

(65) Prior Publication Data

US 2022/0127949 A1 Apr. 28, 2022

(51) Int. Cl.
*E21B 44/00* (2006.01)
*E21B 47/007* (2012.01)

(52) U.S. Cl.
CPC ..... *E21B 47/007* (2020.05); *E21B 44/00* (2013.01)

(58) Field of Classification Search
CPC ..... E21B 44/00; E21B 45/00; E21B 47/007
See application file for complete search history.

(56) References Cited

U.S. PATENT DOCUMENTS

RE24,818 E 4/1960 Gresham et al.
3,373,823 A 3/1968 Fullerton, Jr. et al.
3,461,978 A 8/1969 Whittle
4,156,467 A 5/1979 Patton et al.
4,312,223 A 1/1982 Koch
4,434,971 A 3/1984 Cordrey
4,610,005 A 9/1986 Utasi
4,616,321 A 10/1986 Chan
4,662,608 A * 5/1987 Ball ..... E21B 44/00 254/273
4,736,297 A 4/1988 LeJeune
4,787,244 A 11/1988 Mikolajczyk
(Continued)

FOREIGN PATENT DOCUMENTS

CA 2994334 A1 2/2017
CN 103711431 A 4/2014
(Continued)

OTHER PUBLICATIONS

Lai, Stephen William et al., "Stick/Slip Detection and Friction-Factor Testing with Surface-Based Torque and Tension Measurements", SPE-170624-PA, Society of Petroleum Engineers, vol. 31, Issue 2, May 2016 (15 pages).
(Continued)

*Primary Examiner* — Tara Schimpf
*Assistant Examiner* — Lamia Quaim
(74) *Attorney, Agent, or Firm* — Osha Bergman Watanabe & Burton LLP

(57) ABSTRACT

A monitoring system for a drill string controlled by a drilling program may include a contactless sensor arranged to capture data associated with a parameter at a position along a drill line associated with the drill string of a drilling system. The system may include a processor operatively connected to the contactless sensor. The processor may be configured to interpret the data and to cause an adjustment to the drilling program based on the interpreted data.

18 Claims, 7 Drawing Sheets

(56) References Cited

U.S. PATENT DOCUMENTS

| | | | | |
|---|---|---|---|---|
| 6,354,158 | B1 | 3/2002 | Eidem et al. | |
| 8,789,585 | B2 | 7/2014 | Leising et al. | |
| 2003/0234119 | A1 | 12/2003 | Ray | |
| 2006/0098531 | A1* | 5/2006 | Gardner | E21B 47/16 367/82 |
| 2012/0241217 | A1* | 9/2012 | Davis | E21B 44/00 175/26 |
| 2015/0345261 | A1 | 12/2015 | Kruspe et al. | |
| 2016/0290046 | A1* | 10/2016 | Orban | E21B 47/007 |
| 2016/0290121 | A1 | 10/2016 | Wesley et al. | |
| 2017/0089696 | A1 | 3/2017 | Smith et al. | |
| 2017/0145807 | A1* | 5/2017 | Wendorf | H04N 23/63 |
| 2018/0245445 | A1 | 8/2018 | Theis et al. | |
| 2019/0032469 | A1* | 1/2019 | Chatelet | E21B 33/08 |
| 2019/0136650 | A1 | 5/2019 | Zheng et al. | |
| 2020/0126386 | A1* | 4/2020 | Michalopulos | G08B 7/06 |
| 2020/0173233 | A1* | 6/2020 | Orban | E21B 44/00 |
| 2020/0174149 | A1 | 6/2020 | Thiruvenkatanathan | |
| 2020/0190959 | A1 | 6/2020 | Gooneratne et al. | |
| 2020/0190967 | A1 | 6/2020 | Gooneratne et al. | |
| 2020/0200930 | A1* | 6/2020 | Parmeshwar | E21B 19/16 |
| 2020/0224523 | A1* | 7/2020 | Parmeshwar | E21B 19/165 |
| 2020/0278193 | A1* | 9/2020 | Orban | G01B 11/2433 |

FOREIGN PATENT DOCUMENTS

| | | | |
|---|---|---|---|
| CN | 104265262 | A | 1/2015 |
| CN | 209040821 | U | 6/2019 |
| GB | 2275778 | A | 9/1994 |
| RU | 94036257 | A1 | 11/1996 |
| WO | 2015051027 | A1 | 4/2015 |
| WO | 2016118714 | A1 | 7/2016 |
| WO | 2020/086594 | A1 | 4/2020 |

OTHER PUBLICATIONS

Lai, Stephen William et al., "Stick-Slip Detection and Friction Factor Testing Using Surface-Based Torque and Tension Measurements", SPE-170624-MS, Society of Petroleum Engineers, Oct. 2014 (18 pages).

International Search Report and Written Opinion of the International Searching Authority issued in corresponding International Application No. PCT/US2021/056592 mailed on Feb. 14, 2022 (14 pages).

* cited by examiner

MONITORING A DRILL STRING CONTROLLED BY A DRILLING PROGRAM

BACKGROUND

Generally, when performing drilling activities to develop an oil or gas field, a field operator company may rely on drilling contractors to execute drilling operations. Such drilling contractors normally work with different types of equipment, and may have different levels of skill.

The variety in equipment and skill level may contribute to inconsistencies in the Rate Of Penetration (ROP) while drilling wells in similar locations. In addition, different drilling crews can respond in different ways when addressing unexpected conditions or events, such as high lateral downhole vibrations, stick and slips, or other problems that contribute to a reduced ROP. On some occasions, wrong actions by a drilling crew may cause larger problems, such as stuck pipes, twist-offs, or fatigue failures, which may lead to extensive Non Productive Time (NPT).

Accordingly, there exists a need for a system to monitor a drill string of a drilling system and to identify a condition associated with the drill string based on data obtained during the monitoring of the drill string.

SUMMARY

This summary is provided to introduce concepts that are further described below in the detailed description. This summary is not intended to identify key or essential features of the claimed subject matter, nor is it intended to be used as an aid in limiting the scope of the claimed subject matter.

In general, in one aspect, embodiments disclosed herein relate to a monitoring system for a drill string controlled by a drilling program. The system includes a contactless sensor arranged to capture data associated with a parameter at a position along a drill line associated with the drill string of a drilling system. The system includes a processor operatively connected to the contactless sensor. The processor is configured to interpret the data and to cause an adjustment to the drilling program based on the interpreted data.

In general, in one aspect, embodiments disclosed herein relate to a method for monitoring a drill string controlled by a drilling program. The method includes, using a contactless sensor, capturing data associated with a parameter at a position along a drill line associated with the drill string of a drilling system. The method includes, using a processor, interpreting the data. The method includes, using the processor, causing an adjustment to the drilling program based on the interpreted data.

In general, in one aspect, embodiments disclosed herein relate to a non-transitory machine-readable storage medium comprising instructions that, when executed by one or more processors of a machine, cause the machine to perform operations. The operations include capturing data associated with a parameter at a position along a drill line associated with the drill string of a drilling system. The operations include interpreting the data. The operations include causing an adjustment to the drilling program based on the interpreted data.

Other aspects and advantages of the claimed subject matter will be apparent from the following description and the appended claims.

BRIEF DESCRIPTION OF DRAWINGS

Some embodiments are illustrated by way of example and not limitation in the figures of the accompanying drawings.

DETAILED DESCRIPTION

Figure 1:
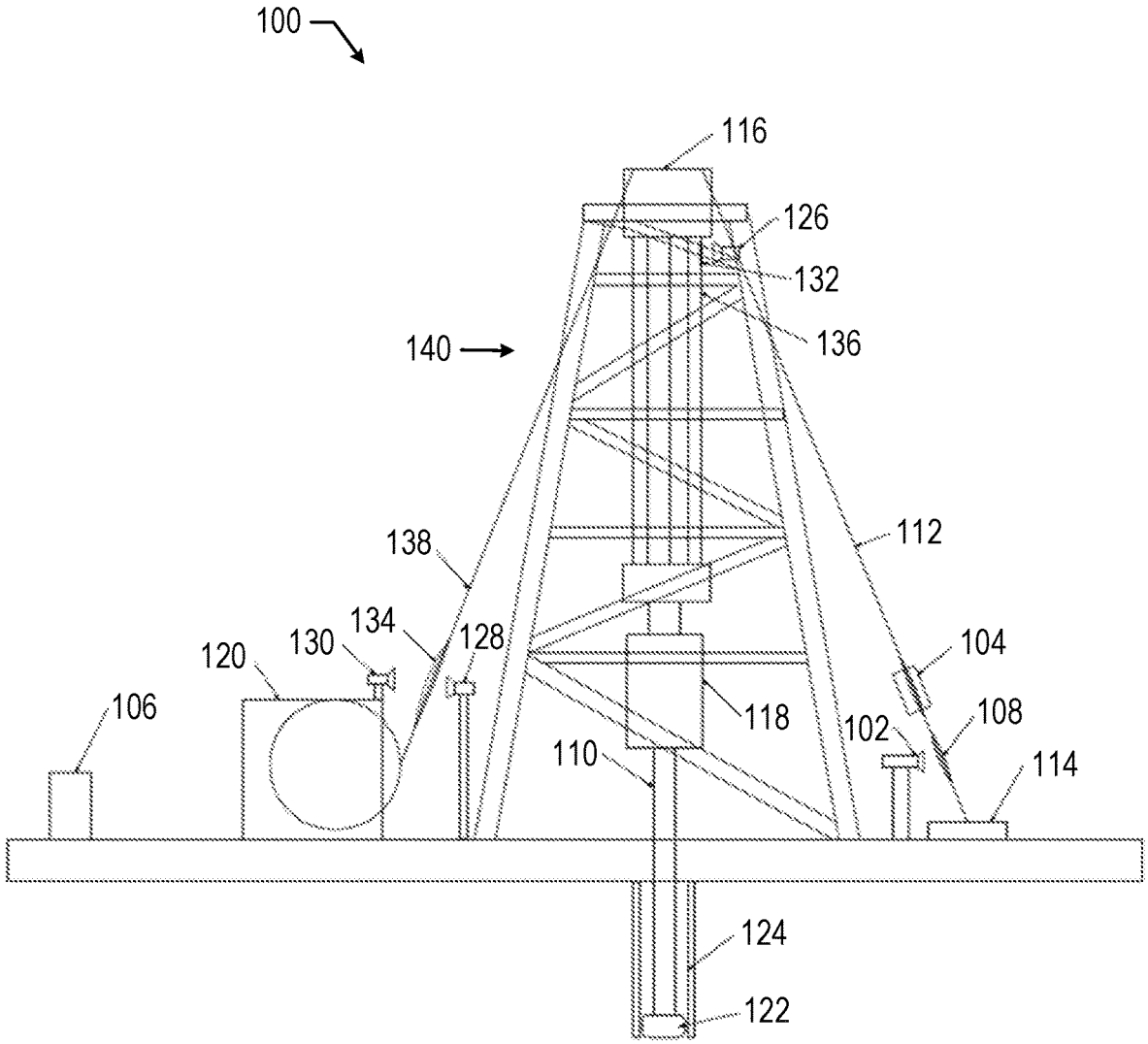
FIG. 1 is a schematic illustration of a well environment, according to one or more example embodiments.

Example systems and methods for monitoring a drill string controlled by a drilling program are described. Unless explicitly stated otherwise, components and functions are optional and may be combined or subdivided. Similarly, operations may be combined or subdivided, and their sequence may vary.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, or third) may be used as an adjective for an element (that is, any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

A drilling rig is a complex system of various types of equipment that require comprehensive monitoring in order to facilitate an efficient and effective drilling operation. Traditionally, contact sensors have been used to measure various aspects of oil and gas production. However, there exists a need for a system to monitor a drill string of a drilling system and to identify an unwanted condition associated with the drill string based on data obtained during the monitoring of the drill string. In some example embodiments, such a monitoring system may automatically diagnose and correct the unwanted condition based on the observable effect on a drill line caused by the vibration or oscillation of the drill string during the operation of the drilling rig.

In one aspect, example embodiments disclosed herein relate to a monitoring system for monitoring a drill string controlled by a drilling program. The monitoring system includes one or more contactless sensors that may be directed at various areas of a drilling system (e.g., a drill line or an item of equipment attached to, in contact with, or in proximity to the drill line) to automatically capture data describing a physical state of the drill line. Examples of contactless sensors are acoustic sensors, vibration sensors, temperature sensors, and cameras. In some instances, the data captured by the one or more contactless sensors is aggregated and synchronized with data captured by one or more contact sensors that may be mounted on various areas of the drilling system to capture additional data pertaining to the condition of the drill line. This may facilitate the identifying and linking of drill line behavior signatures and downhole event signatures for the purpose of obtaining a more comprehensive understanding of the unwanted condition.

The monitoring system may analyze the captured data to identify unwanted drill string behavior, such as excessive vibration of the drill line, weight on bit (WOB), or inconsistencies in the ROP. Identifying changes in drill line behavior may assist in diagnosing causes of suboptimal drilling operations. Based on determining a condition that leads to suboptimal drilling operations, the monitoring system may cause an adjustment to the drilling program that controls the drill string in order to optimize the drilling operations (e.g., by increasing the energy transfer to the bit and preventing the destruction of the bottom hole assembly (BHA) components, drill pipes, or drill bit). In some instances, the causing of the adjustment to the drilling program includes determining a further (e.g., optimized) input parameter that may reduce or prevent the unwanted condition that causes the suboptimal drilling operations.

In some example embodiments, the monitoring system performs the data analysis in the cloud. In some example embodiments, the monitoring system performs the data analysis on the surface, at a drilling well site. In some example embodiments, the data analysis is performed on a smart sensor by one or more processors included in the smart sensor.

An advantage of the monitoring system is the ability to automatically identify and correct, in real-time or near real-time, an undesired condition of a drill string based on data descriptive of a drill line, automatically captured using contactless sensors directed at the drill line. Another advantage is the increased accuracy in determining the cause of undesired conditions associated with the drill string. A third advantage is the minimization or elimination of human error with respect to the identifying of solutions to correct the undesired conditions of the drill string in order to improve the operations of a drilling system.

FIG. 1 is a schematic illustration of a well environment 100, according to one or more example embodiments. The well environment 100 includes a drilling rig 140 with a well 124 extending from the surface into a target zone of a formation, such as a reservoir. The drilling rig 140 may include a drill string 110, a drill line 112 (also shown as items 136 and 138), a deadline anchor 114, a crown block 116, a top drive 118, a drawworks 120, and a drill bit 122.

In some example embodiments, the well environment 100 also includes one or more contactless sensors 102, 126, 128, and 130 that are directed at various areas (e.g., 108, 132, and 134) of the drill line 112 to capture data pertaining to one or more parameters associated with the drill line 112 or other drilling equipment. Examples of the one or more parameters are Rotation Per Minute (RPM), WOB, torque, water flow, movement of the drill line, deformation of the drill line, tension of the drill line, and noise. In some instances, the well environment 100 may also include a contact sensor 104 that is attached to the drill line 112.

In various example embodiments, one or more additional contact or contactless sensors are attached to or directed at an item of equipment attached to, in contact with, or in proximity to the drill line 112 to capture additional data pertaining to the drill line 112 or other parts of the drilling rig 140. An analysis module 106 may aggregate and synchronize the data captured by the sensors 102, 104, 126, 128, and 130 in real-time for rapid analysis. An analysis based on the aggregated and synchronized sensor data may improve a drilling program based on a more comprehensive understanding of how downhole events manifest themselves in physical state changes of various parts of the drilling rig 140.

The data captured by the one or more sensors 102, 104, 126, 128, and 130 may be transmitted wirelessly, by wire, or any other means to the analysis module 106. In some example embodiments, as shown in FIG. 1, the analysis module 106 is located within the well environment 100, in close proximity to the sensors 102, 126, 128, and 130. In certain example embodiments, the analysis module 106 is located remotely (e.g., on a different drilling rig or in the cloud).

In some embodiments, the one or more sensors 102, 104, 126, 128, and 130 and the analysis module 106 are included in a monitoring system for monitoring the drill string. The monitoring system may include a computer system that is similar to the computer systems 700 and 714 described with regard to FIGS. 7A and 7B, respectively, and the accompanying descriptions.

Figure 2:
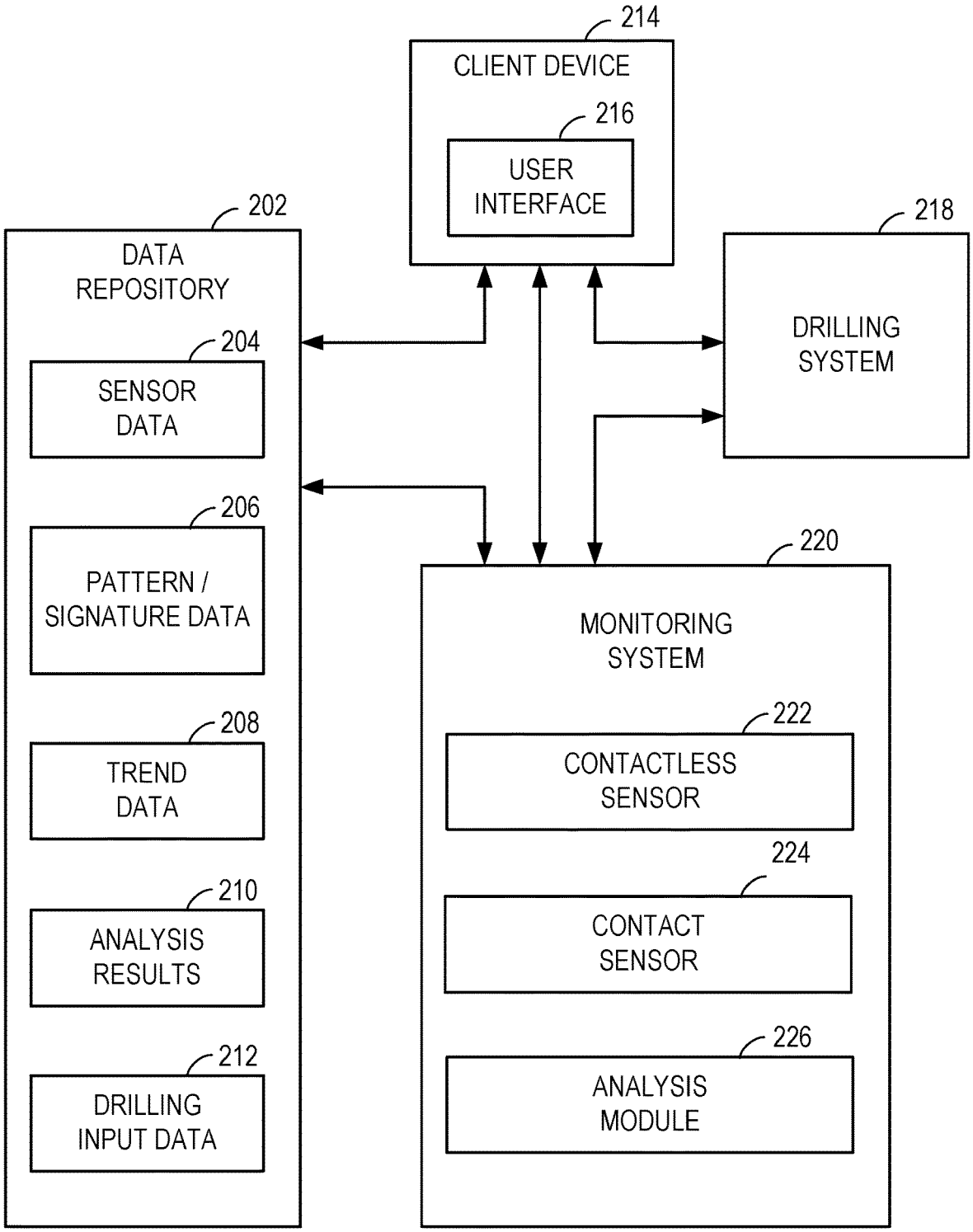
FIG. 2 is a block diagram that illustrates a monitoring system, according to one or more example embodiments.
Figure 3:
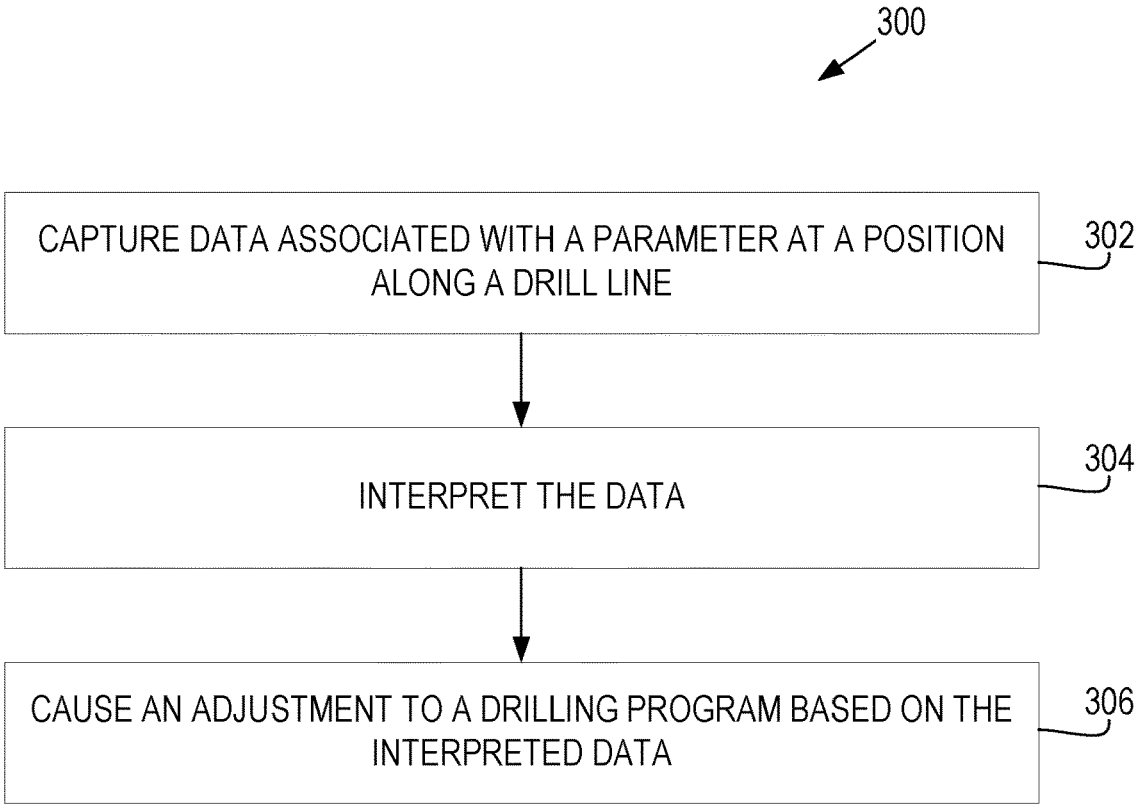
FIGS. 3-6 are flowcharts illustrating operations of the monitoring system in performing a method for monitoring a drill string controlled by a drilling program, according to one or more example embodiments.

FIG. 2 is a block diagram that illustrates a monitoring system, according to one or more example embodiments. In FIG. 2, the monitoring system 220 is operatively connected to a data repository 202, a client device 214, and a drilling system 218. The monitoring system 220 is shown as including a contactless sensor 222 (shown as the sensors 102, 126, 128, and 130 in FIG. 1), a contact sensor 224 (shown as the sensor 104 in FIG. 1), and an analysis module 226 (shown as the analysis module 106 in FIG. 1). The components of the monitoring system 220 are operatively connected and are configured to communicate with each other (e.g., via a bus, shared memory, a switch, wirelessly, etc.).

The contactless sensor 222 is arranged to capture data associated with a parameter (or attribute) at a position along a drill line (shown as the drill line 112 in FIG. 1) associated with the drill string (shown as the drill string 110 in FIG. 1) of a drilling system (shown as the drilling rig 140 of FIG. 1). Examples of the parameter are a tension, a movement, and a noise of the drill line. The sensor data 204 may be interpreted (e.g., processed or analyzed) by the analysis module 226 to identify an undesired condition (hereinafter also "a condition") of the drill string. Examples of undesired conditions of the drill string are BHA failures, bit bouncing, bit whirl, premature wear of the drill bit, BHA whirl, torsional oscillation, high lateral downhole vibrations, stick-and-slips, twist-offs, and fatigue failures. If the monitoring system 220 utilizes several contactless sensors 222, the analysis module 226 may aggregate and synchronize the data captured by the several contactless sensors 222 included in the monitoring system.

In some example embodiments, a contact sensor 224 is placed in contact with a component of a drilling system (e.g., the drill line 112) to capture additional data pertaining to the drilling system. The analysis module 226 may aggregate and synchronize the data captured by the contactless sensor 222 and the contact sensor 224.

In some example embodiments, to identify the undesired condition, the analysis module 226 may compare the captured sensor data 204 and pattern or signature data associated with known conditions of the drill string to identify a match that indicates a particular undesired condition associated with the drill line. In addition, the analysis module 226 may identify data trends based on the sensor data 204, which may be helpful in predicting future problems with the drill string or other components of a drilling system. In some instances, a template (or one or more examples) may be generated for identifying a range of values (e.g., sensor readings) that identify a normal condition for one or more parameters. The sensor data 204 is compared against the template (or the one or more examples) to determine whether the sensor data 204 is within the range of values. The sensor data 204 that is determined to be outside the range of value may be identified (e.g., marked or tagged) as indicating a change in downhole conditions. For example, a comparison of sensor data 204 captured at a particular time and operation and a range of values in a template indicates an unwanted drilling occurrence, such as a drill string failure (e.g., a twist-off) or a drilling break (e.g., a potential for a blow-out).

In addition to generating various analysis results (e.g., identified undesired conditions), the analysis module 226 may generate an optimized input value for an input drilling parameter used in the operation of drilling equipment. Causing an adjustment to a drilling program based on the optimized input value (e.g., providing the optimized input value to an operating item of drilling equipment having the undesired condition) may reduce the undesired condition and improve the operation of the drilling system.

As shown in FIG. 2, the monitoring system 220 is configured to communicate with data repository 202 to access and store various types of data. The data repository 202 may be any type of storage, such as non-persistent storage (e.g., random access memory (RAM), cache memory, or flash memory), one or more persistent storage (e.g., a hard disk), or any other suitable type of memory capable of storing data within data structures such as arrays, lists, tables, etc. The data repository 202 stores the sensor data 204, pattern/signature data 206, trend data 208, analysis results 210, and drilling input data 212. In some example embodiments, the sensor data 204 includes the sensor data that was received from several sensors and that has been aggregated and synchronized.

The monitoring system 220 is also configured to communicate with a drilling system 218 to cause an adjustment to the drilling program that controls the drill string, based on the interpreted sensor data 204 captured by the sensor 220. In some example embodiments, the causing of the adjustment to the drilling program includes causing a modification in the functionality of an item of equipment associated with the identified condition (e.g., the drill string). According to an example, during drilling operations, the sensor 220 records an undesired condition pertaining to the drill string, such as a significant vibration coming from the drill string. The monitoring system 220 transmits an instruction to the drilling system 218 based on the detection of the significant vibration. The instruction may include a command to perform an action that results in a minimization of the excessive vibration. Examples of the action are changing the weight on bit, changing the rotation speed, adjusting a pump, activating or deactivating a downhole tool (e.g., an underreamer), or changing a drilling trajectory by adjusting the path of a rotary steerable system tool or by changing the angle of a downhole bent sub. In various example embodiments, the causing of the adjustment to the drilling program includes transmitting an instruction to the drilling system based on detecting an undesired condition pertaining to the drill string.

Further, the monitoring system 220 is configured to communicate with a client device 214 that includes a user interface 216. In some example embodiments, the monitoring system 220 generates an alert based on the detected condition pertaining to the drill string, and causes display of the alert in the user interface 216. A user of the client device 214 may access the monitoring system 220 via the user interface 216, for example, to make configuration changes to the sensor 222 or the analysis module 226. The client device 214 is also configured to communicate with the data repository 202 to access and store data. In addition, the client device 214 is also configured to communicate with the drilling system 218.

The analysis module 226 may be implemented using hardware (e.g., one or more processors of a machine) or a combination of hardware and software. For example, the analysis module 226 may configure a processor to perform the operations described herein for the analysis module 226. According to another example, the analysis module 226 is a hardware processor that performs the operations described herein for the analysis module 226. In some example embodiments, the analysis module 226 may be distributed across multiple machines or devices.

FIGS. 3-6 are flowcharts illustrating operations of the monitoring system in performing a method 300 for monitoring a drill string controlled by a drilling program, according to one or more example embodiments. The drilling program is used to manage the operation of a drilling system (e.g., the drilling rig 140 of FIG. 1). Operations of the method 300 may be performed using the components described above with respect to FIG. 2. One or more blocks in FIGS. 3-6 may be performed by a computing system such as that shown and described below in FIGS. 7A and 7B. While the various blocks in FIGS. 3-6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

At Step 302, the contactless sensor 222 captures data associated with a parameter at a position along a drill line associated with the drill string of a drilling system. The capturing of the data may include measuring an absolute value of the parameter at a particular time. According to some example embodiments, the capturing of the data includes measuring at least one of an amount of movement of the drill line, an amount of deformation of the drill line, an amount of tension of the drill line, or a volume of a sound. In certain example embodiments, the capturing of the data includes capturing a change in a shape of the drill line.

At Step 304, a processor (e.g., the analysis module 226 of FIG. 2) interprets the data captured by the contactless sensor 222. To interpret the captured data, the processor may compare the captured data against known data patterns or data signatures to correlate the captured data with known downhole conditions associated with certain data patterns or data signatures. In some example embodiments, a template may be generated to include a range of values that describe normal conditions for one or more parameters associated with the sensor data. If the readings from the sensor falls outside the range of values, in some instances, a notification may be generated and transmitted to a driller to alert him or her of a possible unwanted condition with the drill string. In some example embodiments, one or more drilling input parameters (e.g., WOB, RPM, or torque) may be automatically adjusted to return to normal drilling conditions.

In some example embodiments, the contactless sensor 222 is a first sensor arranged to capture a first set of data associated with the parameter at a first position along the drill line. A second sensor (e.g., another contactless sensor 222 or a contact sensor 224) is arranged to capture a second set of the data associated with the parameter at a second position along the drill line. The processor aggregates the first set of data and the second set of data. The aggregating results in aggregated data. According to these example embodiments, the data being interpreted, by the processor, at Step 304, includes the aggregated data.

In various example embodiments, the processor synchronizes the aggregated data. The synchronizing results in synchronized data. According to these example embodiments, the data being interpreted, by the processor, at Step 304, includes the synchronized data.

At Step 306, the processor causes an adjustment to the drilling program based on the interpreted data. The adjustment to the drilling program serves to improve the operation of the drilling system, for example, by maintaining the BHA durability (e.g., by reducing excessive lateral or axial vibrations, reducing stick-and-slips, reducing bit bouncing, identifying formation changes, or identifying drilling breaks) or by optimizing the ROP. Further details with respect to the operations of the method 300 are described below with respect to FIGS. 4-6.

Figure 4:
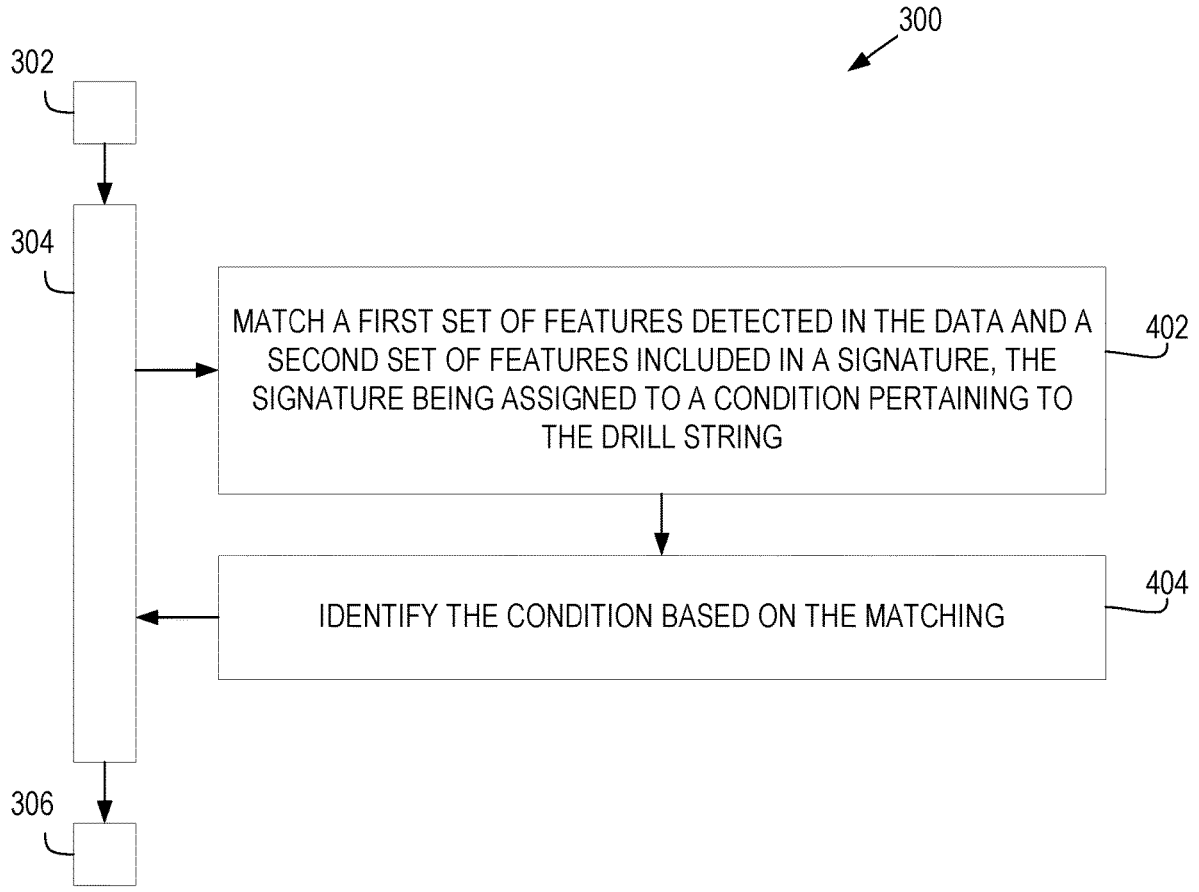

As shown in FIG. 4, the method 300 may include one or more of Steps 402 and 404, according to some example embodiments. Step 402 may be performed as part of (e.g., a precursor task, a subroutine, or a portion) of Step 304, in which the processor interprets the data captured by the contactless sensor 222. At Step 402, the processor matches a first set of features detected in the data and a second set of features included in a signature. In some instances, the second set of features includes historical data descriptive of one or more previously encountered conditions (or anomalies). The processor may access the signature form the data repository 202 where the signature is stored as the pattern/signature data 206.

At Step 404, the processor identifies the condition pertaining to the drill string based on the matching of the first set of features detected in the data and the second set of features included in the signature. For example, when the processor recognizes that the features that are included in the signature are also included in the captured data, the processor determines that the captured data indicates the existence of a condition that was previously encountered and is identified by the features included in the signature.

Examples of anomalies that may be identified based on matching the first set of features detected in the data and the second set of features included in the signature are stick slips, BHA whirl, or bit bouncing. Such unwanted conditions may lead to failure of the drill string, drilling components, or excessive wearing of the bit. If the processor matches the data from the current operations with the historical data that identifies an anomaly in the signature, then the processor may cause a change in the drilling inputs in order to correct the condition that is causing the downhole dysfunction.

Figure 5:
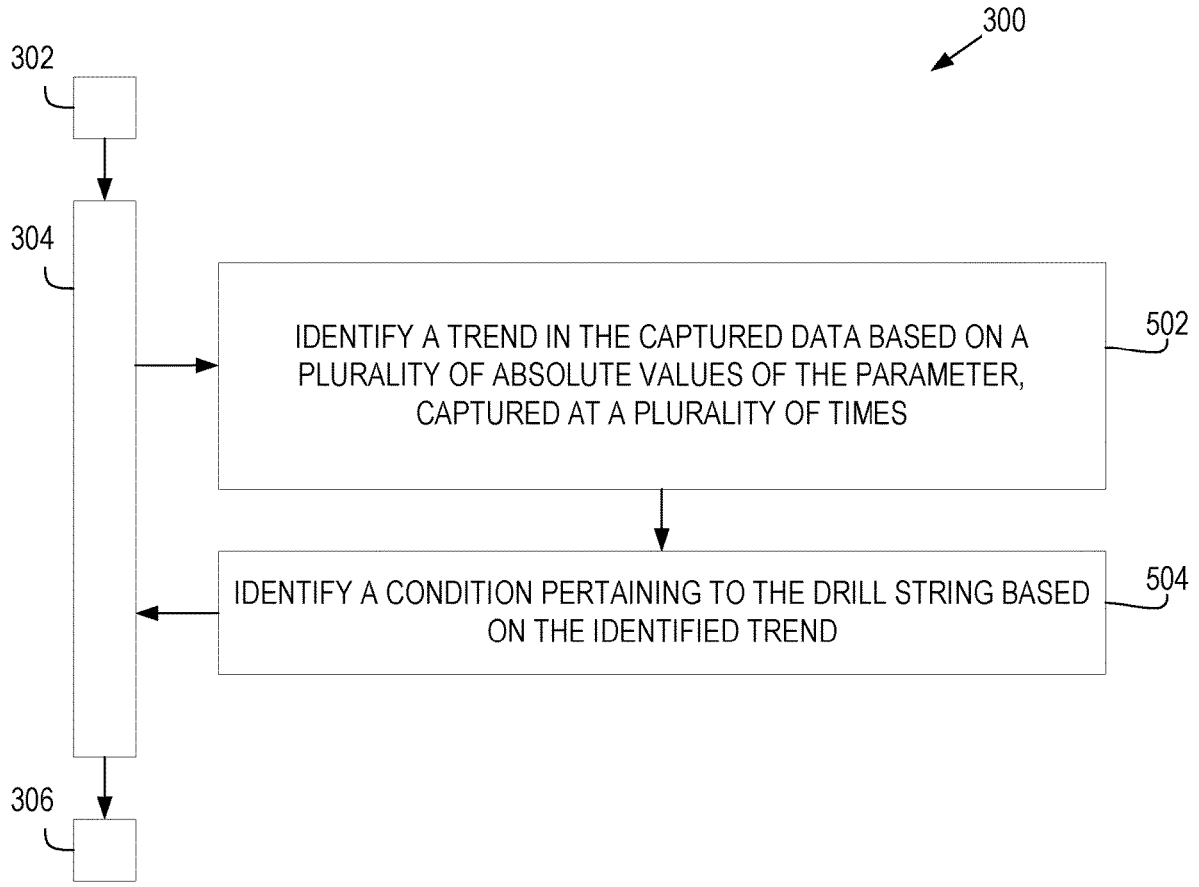

As shown in FIG. 5, the method 300 may include one or more of Steps 502 and 504, according to some example embodiments. Step 502 may be performed as part of (e.g., a precursor task, a subroutine, or a portion) of Step 304, in which the processor interprets the data captured by the contactless sensor 222. At Step 502, the processor identifies a trend in the captured data based on a plurality of absolute values of the parameter, captured at a plurality of times. A trend is the general direction of the change in the values of a parameter over a period of time. In some instances, trends in data are an early indicator that the drilling inputs are pushing the downhole system towards boundaries where a significant downhole dysfunctions might start developing.

At Step 504, the processor identifies a condition pertaining to the drill string based on the identified trend. In some example embodiments, an increase (or decrease) in values associated with a parameter indicates the existence of particular unwanted condition.

Figure 6:
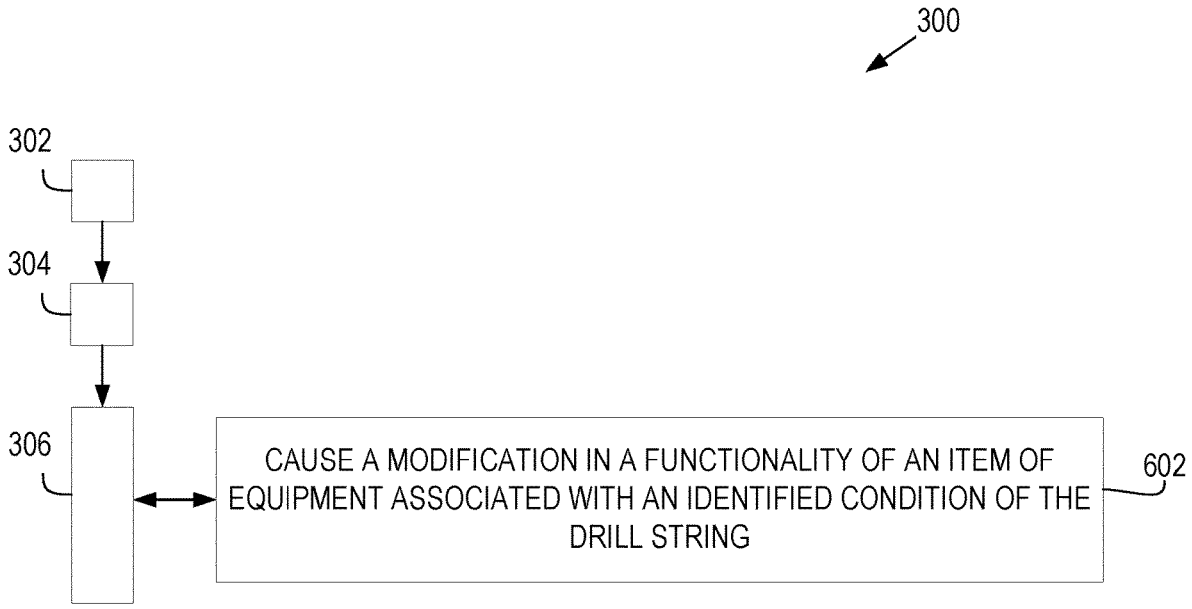

As shown in FIG. 6, the method 300 may include Step 602, according to some example embodiments. Step 602 may be performed as part of (e.g., a precursor task, a subroutine, or a portion) of Step 306, in which the processor causes an adjustment to the drilling program based on the interpreted data. At Step 602, the processor causes a modification in a functionality of an item of equipment associated with the identified condition (e.g., the drill string). Once drilling dysfunctions are detected, in some example embodiments, the monitoring system 220 takes a corrective actions to change drilling inputs (e.g., change the WOB, torque, RPM, or flow volume; activating or deactivating downhole tools, such as an underreamer; or adjust a drilling trajectory by changing the path of a rotary steerable system tool or by changing the angle of a downhole bent sub to avoid problematic paths). In some example embodiments, the causing of the adjustment to the drilling program includes transmitting an instruction to the drilling system based on the identifying of the condition pertaining to the drill string. The instruction may include a reference to one or more changed drilling inputs.

In various example embodiments, the processor is further configured to generate an optimized input parameter based on the identified condition. The instruction transmitted to the drilling system refers to the optimized input parameter, and the causing of the adjustment to the drilling program is based on the optimized input parameter. In some example embodiments, a template including a range of optimal sensor values is generated. The drilling system 218 generally is configured to perform its operations such that the captured sensor readings stay within the range of optimal sensor values. In the event that captured sensor readings deviate from the range of optimal sensor values, the monitoring system 220 may adjust one or more drilling input values, such as WOB, torque, RPM, or flow-in, to attempt to bring the captured sensor data within the range of optimal values, or at least to slow down the rate of deviation from the optimal sensor values.

Figure 7A:
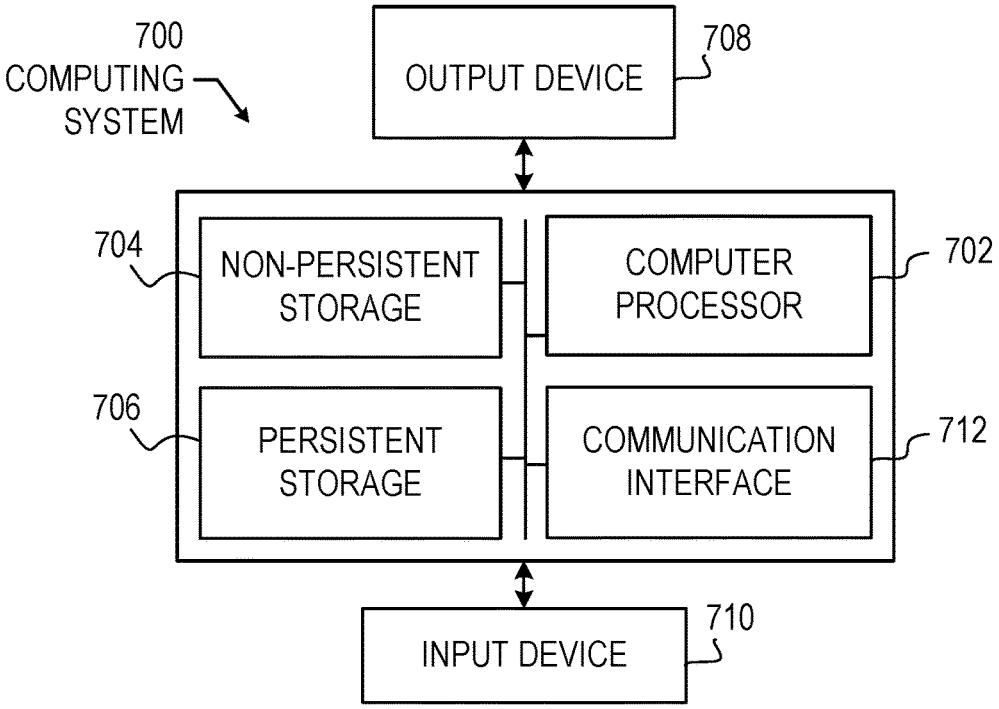
FIGS. 7A and 7B illustrate a computing system, according to one or more example embodiments.

Example embodiments may be implemented on a computing system. Any combination of mobile, desktop, server, router, switch, embedded device, or other types of hardware may be used. For example, as shown in FIG. 7A, the computing system 700 may include one or more computer processors 702, non-persistent storage 704 (e.g., volatile memory, such as random access memory (RAM) or cache memory), persistent storage 706 (e.g., a hard disk, an optical drive such as a compact disk (CD) drive or digital versatile disk (DVD) drive, or a flash memory), a communication interface 712 (e.g., Bluetooth interface, infrared interface, network interface, or optical interface), and numerous other elements and functionalities.

The computer processor(s) 702 may be an integrated circuit for processing instructions. For example, the computer processor(s) 702 may be one or more cores or microcores of a processor. The computing system 700 may also include one or more input devices 710, such as a touchscreen, keyboard, mouse, microphone, touchpad, or electronic pen.

The communication interface 712 may include an integrated circuit for connecting the computing system 700 to a network (not shown) (e.g., a local area network (LAN), a wide area network (WAN), such as the Internet, mobile network, or any other type of network) or to another device, such as another computing device.

Further, the computing system 700 may include one or more output devices 708, such as a screen (e.g., a liquid crystal display (LCD), a plasma display, touchscreen, cathode ray tube (CRT) monitor, or projector), a printer, external storage, or any other output device. One or more of the output devices may be the same or different from the input device(s). The input and output device(s) may be locally or remotely connected to the computer processor(s) 702, non-persistent storage 704, and persistent storage 706. Many different types of computing systems exist, and the aforementioned input and output device(s) may take other forms.

Software instructions in the form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that when executed by a processor(s) is configured to perform one or more embodiments of the disclosure.

Figure 7B:
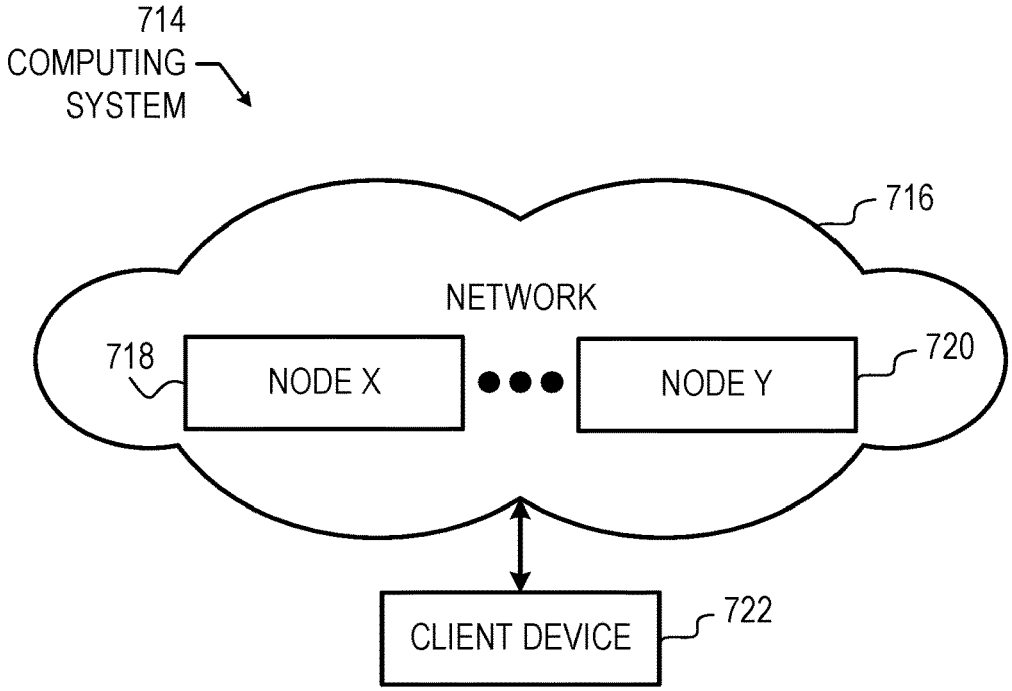

The computing system 700 in FIG. 7A may be connected to or be a part of a network. For example, as shown in FIG. 7B, the network 716 may include multiple nodes (e.g., node X 718 or node Y 720). Each node may correspond to a computing system, such as the computing system shown in FIG. 7A, or a group of nodes combined may correspond to the computing system shown in FIG. 7A. By way of an example, embodiments of the disclosure may be implemented on a node of a distributed system that is connected to other nodes. By way of another example, embodiments of the disclosure may be implemented on a distributed computing system having multiple nodes, where each portion of the disclosure may be located on a different node within the distributed computing system. Further, one or more elements of the aforementioned computing system 700 may be located at a remote location and connected to the other elements over a network.

Although not shown in FIG. 7B, the node may correspond to a blade in a server chassis that is connected to other nodes via a backplane. By way of another example, the node may correspond to a server in a data center. By way of another example, the node may correspond to a computer processor or micro-core of a computer processor with shared memory or resources.

The nodes (e.g., node X 718 or node Y 720) in the network 716 may be configured to provide services for a client device 722. For example, the nodes may be part of a cloud computing system. The nodes may include functionality to receive requests from the client device 722 and transmit responses to the client device 722. The client device 722 may be a computing system, such as the computing system shown in FIG. 7A. Further, the client device 722 may include or perform all or a portion of one or more embodiments of the disclosure.

The computing system or group of computing systems described in FIGS. 7A and 7B may include functionality to perform a variety of operations disclosed herein. For example, the computing system(s) may perform communication between processes on the same or different systems. A variety of mechanisms, employing some form of active or passive communication, may facilitate the exchange of data between processes on the same device. Examples representative of these inter-process communications include, but are not limited to, the implementation of a file, a signal, a socket, a message queue, a pipeline, a semaphore, shared memory, message passing, and a memory-mapped file. Further details pertaining to a couple of these non-limiting examples are provided in subsequent paragraphs.

Based on the client-server networking model, sockets may serve as interfaces or communication channel endpoints enabling bidirectional data transfer between processes on the same device. Foremost, following the client-server networking model, a server process (e.g., a process that provides data) may create a first socket object. Next, the server process binds the first socket object, thereby associating the first socket object with a unique name or address. After creating and binding the first socket object, the server process then waits and listens for incoming connection requests from one or more client processes (e.g., processes that seek data). At this point, when a client process wishes to obtain data from a server process, the client process starts by creating a second socket object. The client process then proceeds to generate a connection request that includes at least the second socket object and the unique name or address associated with the first socket object. The client process then transmits the connection request to the server process. Depending on availability, the server process may accept the connection request, establishing a communication channel with the client process, or the server process, busy in handling other operations, may queue the connection request in a buffer until the server process is ready. An established connection informs the client process that communications may commence. In response, the client process may generate a data request specifying the data that the client process wishes to obtain. The data request is subsequently transmitted to the server process. Upon receiving the data request, the server process analyzes the request and gathers the requested data. Finally, the server process then generates a reply including at least the requested data and transmits the reply to the client process. The data may be transferred, more commonly, as datagrams or a stream of characters (e.g., bytes).

Rather than or in addition to sharing data between processes, the computing system performing one or more embodiments of the disclosure may include functionality to receive data from a user. For example, in one or more embodiments, a user may submit data via a graphical user interface (GUI) on the user device. Data may be submitted via the graphical user interface by a user selecting one or more graphical user interface widgets or inserting text and other data into graphical user interface widgets using a touchpad, a keyboard, a mouse, or any other input device. In response to selecting a particular item, information regarding the particular item may be obtained from persistent or non-persistent storage by the computer processor. Upon selection of the item by the user, the contents of the obtained data regarding the particular item may be displayed on the user device in response to the selection by the user.

By way of another example, a request to obtain data regarding the particular item may be sent to a server operatively connected to the user device through a network. For example, the user may select a uniform resource locator (URL) link within a web client of the user device, thereby initiating a Hypertext Transfer Protocol (HTTP) or other protocol request being sent to the network host associated with the URL. In response to the request, the server may extract the data regarding the particular selected item and send the data to the device that initiated the request. Once the user device has received the data regarding the particular item, the contents of the received data regarding the particular item may be displayed on the user device in response to the selection by the user. Further to the above example, the data received from the server after selecting the URL link may provide a web page in Hyper Text Markup Language (HTML) that may be rendered by the web client and displayed on the user device.

The computing system in FIG. 7A may implement or be connected to a data repository. For example, one type of data repository is a database. A database is a collection of information configured for ease of data retrieval, modification, re-organization, and deletion. Database management system (DBMS) is a software application that provides an interface for users to define, create, query, update, or administer databases.

The user, or software application, may submit a statement or query into the DBMS. Then the DBMS interprets the statement. The statement may be a select statement to request information, update statement, create statement, delete statement, etc. Moreover, the statement may include parameters that specify data, or data container (database, table, record, column, view, etc.), identifier(s), conditions (comparison operators), functions (e.g., join, full join, count, or average), sort (e.g., ascending or descending), or others. The DBMS may execute the statement. For example, the DBMS may access a memory buffer, a reference or index a file for read, write, deletion, or any combination thereof, for responding to the statement. The DBMS may load the data from persistent or non-persistent storage and perform computations to respond to the query. The DBMS may return the result(s) to the user or software application.

The computing system of FIG. 7A may include functionality to present raw or processed data, such as results of comparisons and other processing. For example, presenting data may be accomplished through various presenting methods. Specifically, data may be presented through a user interface provided by a computing device. The user interface may include a GUI that displays information on a display device, such as a computer monitor or a touchscreen on a handheld computer device. The GUI may include various GUI widgets that organize what data is shown as well as how data is presented to a user. Furthermore, the GUI may present data directly to the user, for example, data presented as actual data values through text, or rendered by the computing device into a visual representation of the data, such as through visualizing a data model.

For example, a GUI may first obtain a notification from a software application requesting that a particular data object be presented within the GUI. Next, the GUI may determine a data object type associated with the particular data object, for example, by obtaining data from a data attribute within the data object that identifies the data object type. Then, the GUI may determine any rules designated for displaying that data object type, for example, rules specified by a software framework for a data object class or according to any local parameters defined by the GUI for presenting that data object type. Finally, the GUI may obtain data values from the particular data object and render a visual representation of the data values within a display device according to the designated rules for that data object type.

The previous description of functions presents only a few examples of functions performed by the computing system of FIG. 7A and the nodes or client device in FIG. 7B. Other functions may be performed using one or more embodiments of the disclosure.

While the disclosure has been described with respect to a limited number of embodiments, those skilled in the art, having benefit of this disclosure, will appreciate that other embodiments can be devised which do not depart from the scope of the disclosure as disclosed. Accordingly, the scope of the disclosure should be limited only by the attached claims.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A monitoring system for a drill string controlled by a drilling program, the system comprising:

a contactless sensor arranged to capture data directly from a drill line at a position outside of a top drive along the drill line, wherein the drill line is configured to control movement of the drill string of a drilling system, and wherein the contactless sensor is configured to capture the data without contacting the drill line; and a processor operatively connected to the contactless sensor and configured to:

receive the data from the contactless sensor;

automatically identify one or more changes in a behavior of the drill line based on the data captured directly from the drill line, comprising:

detecting a first set of features in the data corresponding to the one or more changes in the behavior of the drill line, identifying a signature comprising a second set of features that match the first set of features, wherein the signature is linked to one or more previously encountered conditions of the drill string, cause an adjustment to the drilling program to correct for the one or more changes indicative of the one or more previously encountered conditions of the drill string, and transmit an instruction to the drilling system to adjust an ongoing drilling operation according to the adjustment to the drilling program.

2. The monitoring system of claim 1, wherein the drilling program is used to manage an operation of the drilling system.

3. The monitoring system of claim 1, wherein the contactless sensor comprises a first sensor arranged to capture a first set of the data, wherein the position is a first position, and wherein the monitoring system further comprises:

a second sensor arranged to capture a second set of the data directly from the drill line at a second position along the drill line, wherein the processor aggregates the first set of data and the second set of data, the aggregating resulting in aggregated data, and wherein the data being interpreted comprises the aggregated data.

4. The monitoring system of claim 1, wherein the automatically identifying one or more changes in the behavior of the drill line comprises:

determining a parameter of the drill line based on the data;

identifying a trend in the data based on a plurality of absolute values of the parameter, captured at a plurality of times; and identifying a condition of the drill string based on the identified trend.

5. The monitoring system of claim 4, wherein the adjustment to the drilling program comprises modifying functionality of equipment associated with the drill string based on the identified condition of the drill string.

6. The monitoring system of claim 4, wherein the processor is further configured to generate an optimized input parameter based on the identified condition of the drill string, and wherein the adjustment to the drilling program is based on the optimized input parameter.

7. The monitoring system of claim 4, wherein the parameter comprises a measured amount of movement of the drill line.

8. The monitoring system of claim 1, wherein the contactless sensor comprises a vibration sensor, and the data captured directly from the drill line comprises a vibration of the drill line.

9. The monitoring system of claim 1, wherein the contactless sensor comprises a temperature sensor, and the data captured directly from the drill line comprises a temperature of the drill line.

10. The monitoring system of claim 1, wherein the contactless sensor comprises an acoustic sensor, and the data captured directly from the drill line comprises a sound from the drill line.

11. The monitoring system of claim 1, wherein the contactless sensor comprises a camera, and data captured directly from the drill line comprises a visual image of the drill line.

12. The monitoring system of claim 1, wherein the instruction comprises at least one selected from the group consisting of:

a command to change a weight on bit used in the ongoing drilling operation, a command to change a torque used in the ongoing drilling operation, a command to change rotations per minute (RPM) used in the ongoing drilling operation, a command to change a flow volume used in the ongoing drilling operation, a command to activate or deactivate a downhole tool used in the ongoing drilling operation, and a command to adjust a drilling trajectory used in the ongoing drilling operation.

13. A method for monitoring a drill string controlled by a drilling program, the method comprising:

using a contactless sensor, capturing data directly from a drill line at a position outside of a top drive along the drill line, wherein the drill line is configured to control movement of the drill string of a drilling system, and wherein the contactless sensor is configured to capture the data without contacting the drill line;

receiving the data, by a processor, from the contactless sensor;

using the data by the processor, automatically identifying one or more changes in a behavior of the drill line, comprising:

detecting a first set of features in the data corresponding to the one or more changes in the behavior of the drill line;

identifying a signature comprising a second set of features that match the first set of features, wherein the signature is linked to one or more previously encountered conditions of the drill string;

using the processor, causing an adjustment to the drilling program to correct for the one or more changes indicative of the one or more previously encountered conditions of the drill string; and using the processor, transmitting an instruction to the drilling system to adjust an ongoing drilling operation according to the adjustment to the drilling program.

14. The method of claim 13, wherein the contactless sensor comprises a first sensor arranged to capture a first set of the data, wherein the position is a first position, and wherein the method further comprises:

using a second sensor, capturing a second set of the data at a second position along the drill line; and using the processor, aggregating the first set of data and the second set of data, the aggregating resulting in aggregated data, and wherein the data being interpreted comprises the aggregated data.

15. The method of claim 13, wherein the automatically identifying changes in the behavior of the drill line comprises:

determining a parameter of the drill line based on the data;

identifying a trend in the captured data based on a plurality of absolute values of the parameter, captured at a plurality of times; and identifying a condition of the drill string based on the identified trend.

16. The method of claim 13, wherein the causing of the adjustment to the drilling program comprises modifying functionality of equipment associated with the drill string based on the identified condition of the drill string.

17. The method of claim 13, further comprising determining an input parameter linked to the signature and applying the input parameter to the drilling program to cause the adjustment.

18. A non-transitory machine-readable storage medium comprising instructions that, when executed by one or more processors of a machine, cause the machine to perform operations comprising:

capturing, using a contactless sensor, data directly from a drill line at a position outside of a top drive along the drill line, wherein the drill line is configured to control movement of a drill string of a drilling system, and wherein the contactless sensor is configured to capture the data without contacting the drill line;

receiving the data from the contactless sensor;

automatically identifying one or more changes in a behavior of the drill line based on the data, comprising:

detecting a first set of features in the data corresponding to the one or more changes in the behavior of the drill line;

identifying a signature comprising a second set of features that match the first set of features, wherein the signature is linked to one or more previously encountered conditions of the drill string;

causing an adjustment to a drilling program configured to control the drill string to correct for the one or more changes indicative of the one or more previously encountered conditions of the drill string; and transmitting an instruction to the drilling system to adjust an ongoing drilling operation according to the adjustment to the drilling program.

* * * * *